US008176997B2

(12) United States Patent
Ohlendorf

(10) Patent No.: US 8,176,997 B2
(45) Date of Patent: May 15, 2012

(54) HAND-HELD POWER TOOL WITH A CHUCK FOR RECEIVING A PERCUSSION WORKING TOOL

(75) Inventor: Oliver Ohlendorf, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 1079 days.

(21) Appl. No.: 11/800,487

(22) Filed: May 3, 2007

(65) Prior Publication Data

US 2007/0261871 A1 Nov. 15, 2007

(30) Foreign Application Priority Data

May 5, 2006 (DE) ..... 10 2006 000 209

(51) Int. Cl.
*B25D 11/00* (2006.01)

(52) U.S. Cl. ..... 173/201; 173/90; 173/212

(58) Field of Classification Search ..... 173/90, 173/117, 118, 122, 201, 212; 408/58–61
See application file for complete search history.

(56) References Cited

U.S. PATENT DOCUMENTS

| | | | | |
|---|---|---|---|---|
| 2,214,800 | A * | 9/1940 | Smith, Sr. | 74/583 |
| 3,718,193 | A * | 2/1973 | Wanner | 173/117 |
| 3,741,317 | A * | 6/1973 | Unterschweiger et al. | 173/109 |
| 4,276,941 | A * | 7/1981 | Wanner et al. | 173/117 |
| 6,325,157 | B1 * | 12/2001 | Arakawa et al. | 173/201 |
| 6,776,245 | B2 * | 8/2004 | Kristen et al. | 173/217 |
| 2001/0003316 | A1 * | 6/2001 | Bertolla | 173/205 |
| 2006/0131042 | A1 * | 6/2006 | Hammerstingl et al. | 173/201 |
| 2006/0222541 | A1 * | 10/2006 | Greitmann et al. | 417/572 |

* cited by examiner

*Primary Examiner* — Thanh Truong
(74) *Attorney, Agent, or Firm* — Abelman, Frayne & Schwab

(57) ABSTRACT

A hand-held power tool includes a work spindle (4)in which a chuck (3) for receiving an axially displaceable, within limits, percussion working tool (2), is mounted on. The work spindle (4) having a coaxial die (5) located in its interior for imparting blows to the percussion working tool (2). At least one cooling air channel (7) extends in an outer housing (6) radially outwardly of the work spindle and opens into a chuck free space (8) which adjoins the work spindle (4). The at least one cooling air channel (7) communicates with the interior of the work spindle through an opening (10, 10') formed in the work spindle. A seal (9, 9') completely flowtight seals the free space (8) outwardly.

5 Claims, 2 Drawing Sheets

HAND-HELD POWER TOOL WITH A CHUCK FOR RECEIVING A PERCUSSION WORKING TOOL

BACKGROUND OF THE INVENTION

1. Field of the Invention

The present invention relates to a hand-held power tool with an integrated chuck for receiving a percussion working tool in particular such as chisel hammer, combi-hammer, etc. with an internal cooling blower for producing a cooling air flow for cooling the power tool motor.

2. Description of the Prior Art

With electrical hand-held power tools which are used for percussion destruction of stone materials, the limitation of penetration of an abrasive dust in dust-sensitive units such as die pre-chamber or inner surface of the guide sleeve of the percussion tool-receiving chuck, represents a substantial contribution to increase of maintenance-free service life.

German Publication DE 19724532 discloses a rotary-percussion hand-held power tool with an integrated chuck for receiving a percussion working tool and in which sealing rings are provided between the work spindle and an actuator sleeve displaceable axially relative to the spindle. The sealing rings dusttightly close, in the chuck at the power tool side thereof, the locking chamber with the locking member or members.

German Publication DE 196 26 254 discloses a rotary-percussion hand-held power tool in which a cooling air for cooling the motor flows through a cooling air channel, which is located in the outer housing radially outwardly of the work spindle, up to a percussion tool-receiving chuck that is integrally formed with the work spindle at the spindle working tool-side. The cooling air is used, in a free space that adjoins the work spindle radially outwardly, for cooling the outer surface of the guide sleeve that is strongly heated as a result of the sliding friction caused by the limited axial displacement therein of the percussion working tool.

German Publication DE 35 240 36 discloses a rotary-percussion hand-held power tool in which a cooling air for cooling the tool motor flows in the work spindle of the power tool along the die up to a combi-tool-receiving chuck, which is releasably mounted on the work spindle at its working tool side, and is used there for blowing out abrasive dust that penetrated into the die pre-chamber from the die pre-chamber. The cooling air, which flows in the power tool between the work spindle and the outer housing, penetrates, through the radial openings in the work spindle, in the axial region of the elongate, prismatic die that forms cooling channels in the work spindle. However, such elongate die is not suitable, because of its high acoustic impedance, for hand-held power tools with a high impact power over 1000 watt.

An object of the invention is to provide a percussion tool-receiving chuck for a high-power percussion hand-held power tool.

SUMMARY OF THE INVENTION

This and other objects of the present invention, which will become apparent hereinafter, are achieved by providing a hand-held power tool including a work spindle located in the outer housing, a chuck for receiving an axially displaceable, within limits, percussion working tool and mounted on the work spindle which includes a coaxial die located in its interior for imparting blows to the percussion working tool, at least one cooling air channel extending in the outer housing radially outwardly of the work spindle and opening into a free space of the chuck which adjoins the work spindle and communicates with the interior of the work spindle through at least one opening formed in the work spindle, and a seal for flowtight sealing the free space outwardly.

With a free space which is sealed outwardly and which communicates with the interior of the work spindle that seals, at its power tool side, a short compact die, the incoming cooling air can be removed essentially only at the working tool side of the work spindle, removing with it dust particles, which could penetrate in the interior of the chuck or the work spindle and/or preventing penetration of new dust particles. With a mounted corresponding percussion working tool, a timely standardized overpressure builds on in the free space which provides for removal of the delivered amount of the cooing air through a radial clearance between the front section of the work spindle that forms the guide sleeve of the chuck which is formed integrally with the work spindle, and the working tool.

Advantageously, the air opening of the work spindle is located in front of, in the operational direction, of the cusp point of the die, so that it can never be closed flowtight by the reciprocating die.

Advantageously, the free space adjoins a locking opening formed in the work spindle for receiving a locking member radially displaceable relative to the work spindle. The free space communicates with the interior of the spindle through an air opening that is formed between the locking opening and the locking member.

Advantageously, the seal is formed as an elastically radially preloaded annular diaphragm seal, preferably of acrylonitrile-butadien resin and which completely circumferentially surrounds an annular gap that adjoins the free space and is formed between the outer housing (primarily, tool side, connection flange) and the chuck, (primarily, the power tool side axially displaceable actuation sleeve). Thereby, the free space is sealed outwardly. Such an annular diaphragm seal is particularly suitable for a non-rotatable chuck of a chisel hammer.

Alternatively, the seal can be formed as an annular labyrinth seal, preferably of polyacetal completely circumferentially surrounding in a contact-free manner, the annular gap that adjoins the free space. Thereby, the free space is flowtight closed outwardly, as only a very insignificant leakage through the labyrinth is possible. Such an annular labyrinth seal is particularly suitable for a rotary chuck of a combi-hammer.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
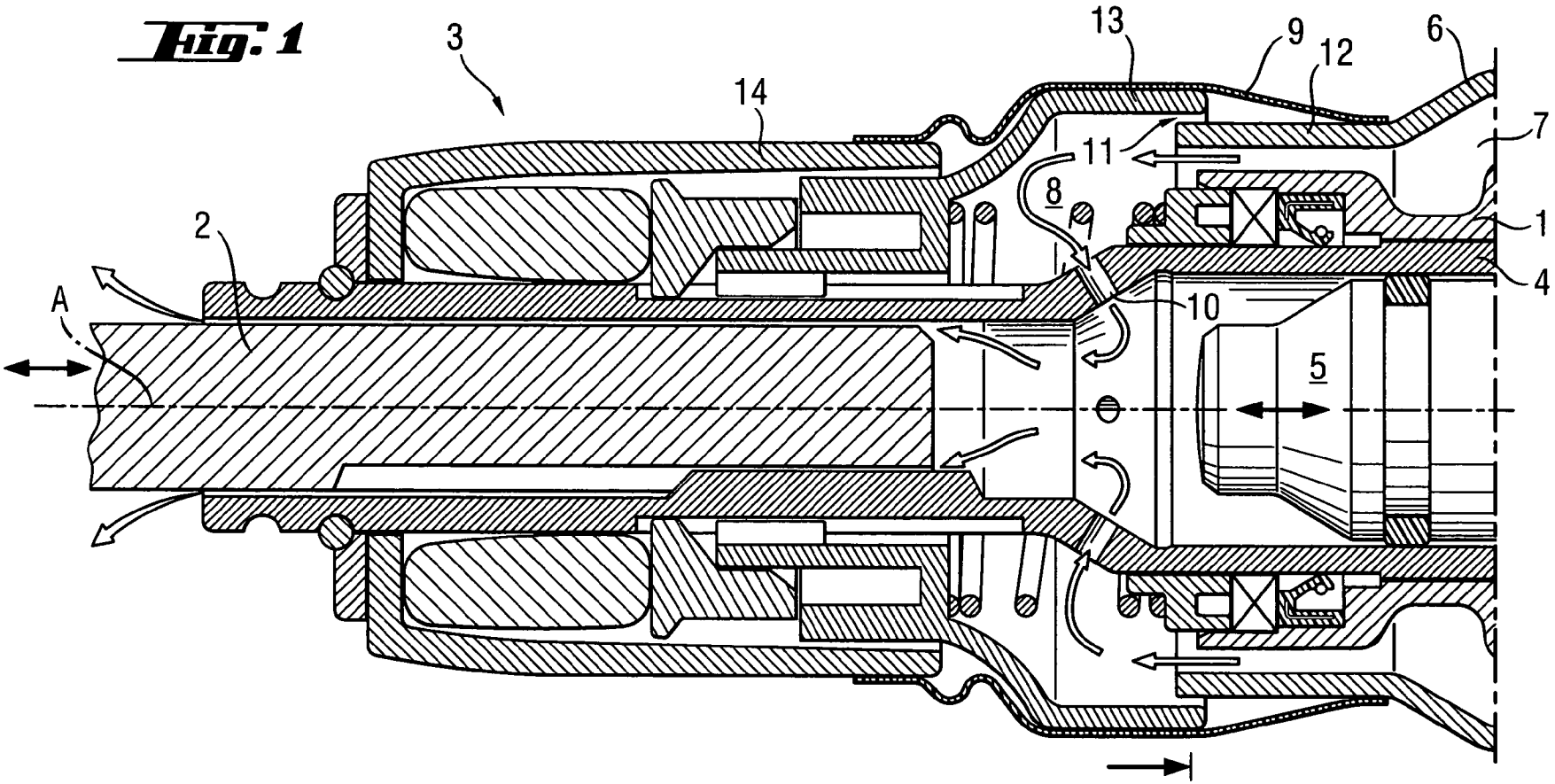
FIG. 1 a cross-sectional view of a hand-held power tool with a chuck for receiving a percussion working tool.
Figure 2:
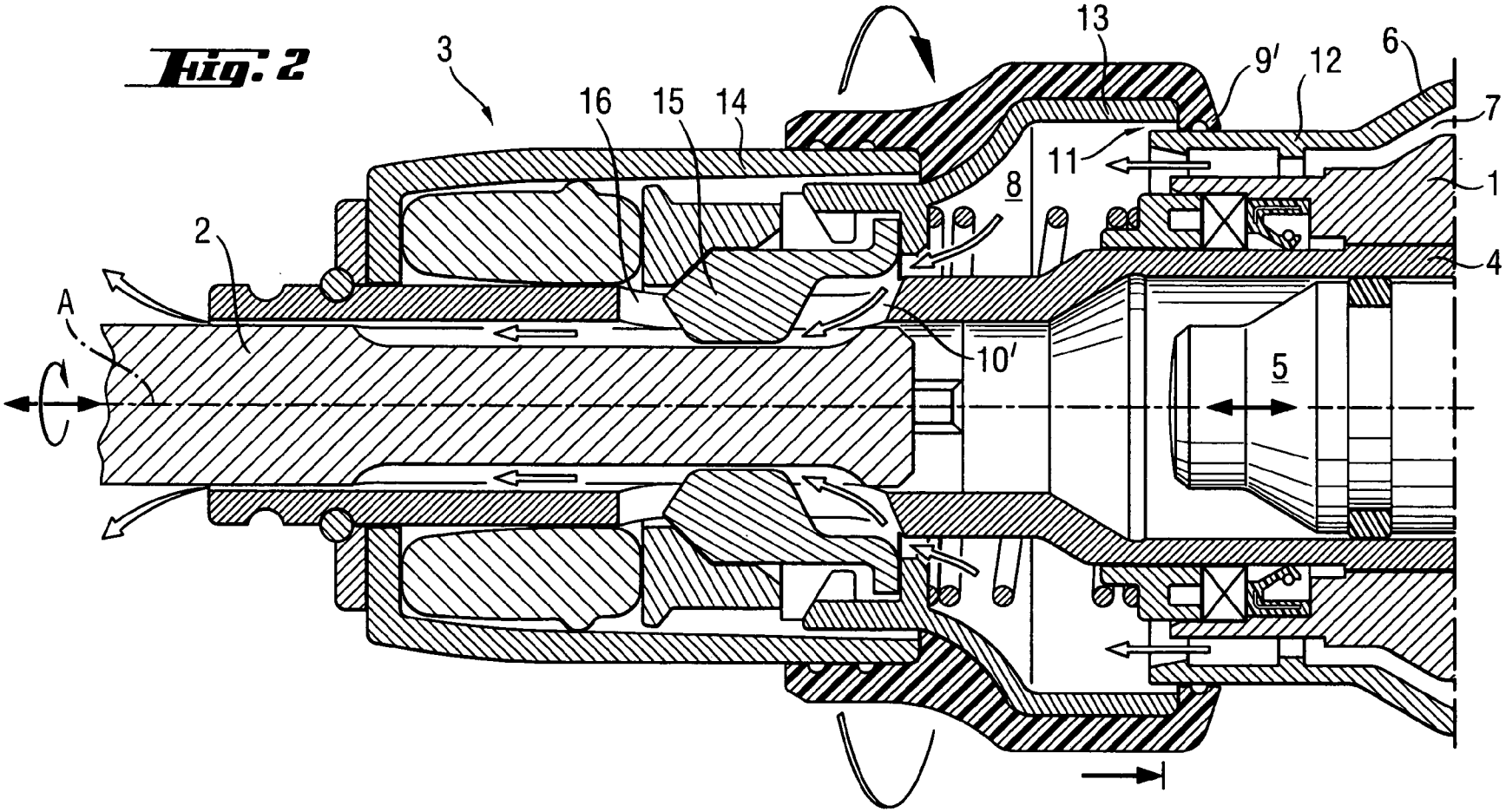
FIG. 2 a cross-sectional view of another embodiment of a hand-held power tool with a chuck for receiving a percussion working tool.

A hand-held power tool 1 according to the present invention, only a portion of which is shown in FIGS. 1-2, is designed for imparting blows along an axis A and includes an integrated chuck 3 for receiving an axially displaceable, within limits, percussion working tool 2. The chuck 3 is mounted on a work spindle 4 having an inner, coaxial, short and compact die 5. The work spindle 4 has, at its working tool side, a narrow section in form of a guide sleeve for guiding the percussion working tool 5. The handheld power tool 1 includes a cooling air channel 7 that extends in an outer housing 6, radially outwardly of the work spindle 4. The cooling air channel 7 opens into a free space 8 of the chuck 3, which is limited by the work spindle 4. The cooling air channel 7 is flowtightly closed outwardly by sealing means 9, 9' and is connected, at its working tool side, with the interior of the work spindle 4 by air openings 10, 10' formed in a wall of the work spindle 5 in front of, in the direction of the working tool 2, a cusp point of the die 5.

As shown in FIG. 1, with a non-rotatable, chuck 3, the seal 9 is formed as a thin annular diaphragm seal from an acrylonitrile-butadien resin, and completely surrounds an annular gap 11 connected with the free space 8 and formed between a cylindrical connection flange 12 of the outer housing 6 and a power tool side, axially displaceable, actuation sleeve 13 of the chuck 13. The annular diaphragm seal 9 is elastically radially preloaded against the connection flange 12 and the actuation sleeve 13. The seal 9 also sealingly extends, in the operational direction of the power tool 1, toward a receiving housing 14 of the chuck 3.

In FIG. 2 in distinction from FIG. 1, with a rotatable chuck 3, the seal 9' is formed as annular labyrinth seal of polyacetal and extends completely circumferentially about the gap 11 connected with the free space 8 and formed between a cylindrical connection flange 12 of the outer housing 6 and a power tool side, axially displaceable, actuation sleeve 13 of the chuck 13. The annular labyrinth seal 9' surrounds the connection flange 12 and the actuation sleeve 13 at a distance of 0.1 mm therefrom (not seen at the scale of the drawing). The seal 9' also sealingly extends, in the operational direction of the power tool 1 toward a receiving housing 14 of the chuck 3. The free space 8 adjoins two locking openings 16 in the work spindle 4 for receiving two locking members 14 radially displaceable relative to the work spindle 4. Thereby, the free space 8 is connected with the interior of the work spindle 4 by two air openings 10' formed between the locking openings 16 of the work spindle 4 and the locking members 15 respectively.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising an outer housing (6); a work spindle (4) located in the outer housing (6); a chuck (3) for receiving an axially displaceable, within limits, percussion working tool (2) and mounted on the work spindle (4), the work spindle (4) including a coaxial die (5) located in an interior thereof for imparting blows to the percussion working tool (2); at least one cooling air channel (7) extending in the outer housing (6) radially outwardly of the work spindle and opening into a free space (8) of the chuck (3) which adjoins the work spindle (4) and communicates with the interior of the work spindle through at least one opening (10, 10') formed in the work spindle (4); and a seal (9, 9') circumferentially surrounding an annular gap (11) that adjoins the free space (8) and is formed between the outer housing (6) and the chuck (3) for completely flowtight sealing the free space (8) outwardly.

2. A hand-held power tool according to claim 1, wherein the at least one opening (10, 10') of the work spindle (4) is located in front of, in an operational direction, a cusp point of the die (5).

3. A hand-held power tool according to claim 1, wherein the free space (8) adjoins a locking opening (16) formed in the work spindle (4) for receiving a locking member (15) radially displaceable relative to the work spindle.

4. A hand-held power tool according to claim 1, wherein the seal (9) is formed as an elastically radially preloaded, annular diaphragm seal.

5. A hand-held tool according to claim 1, wherein the seal (9') is formed as an annular labyrinth seal completely circumferentially surrounding, in a contact-free manner, an annular gap (11) that adjoins the free space (8) and is formed between the outer housing (6) and the chuck (3).

* * * * *